US009625881B2

(12) United States Patent
Morohoshi

(10) Patent No.: US 9,625,881 B2
(45) Date of Patent: Apr. 18, 2017

(54) ELECTRONIC TIMEPIECE

(71) Applicant: CASIO COMPUTER CO., LTD., Shibuya-ku, Tokyo (JP)

(72) Inventor: Hiroshi Morohoshi, Tokorozawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 27 days.

(21) Appl. No.: 14/792,301

(22) Filed: Jul. 6, 2015

(65) Prior Publication Data

US 2016/0041530 A1 Feb. 11, 2016

(30) Foreign Application Priority Data

Aug. 8, 2014 (JP) ..... 2014-162001

(51) Int. Cl.
*G04G 9/00* (2006.01)

(52) U.S. Cl.
CPC ..... *G04G 9/0076* (2013.01); *G04G 9/00* (2013.01)

(58) Field of Classification Search
CPC ..... G04G 9/00; G04G 9/0076; G04G 15/00; G04G 5/002; G04B 21/04
See application file for complete search history.

(56) References Cited

U.S. PATENT DOCUMENTS 5,089,814 A * 2/1992 DeLuca ..... G08B 3/1083 340/7.27
6,393,263 B1 * 5/2002 Hayashi ..... G04G 3/00 368/21
6,876,600 B2 * 4/2005 Ito ..... G04G 9/0076 368/21
8,295,126 B2 * 10/2012 Wood ..... G04G 9/0076 368/21
8,467,272 B2 * 6/2013 Fujisawa ..... G04G 5/002 368/47
8,705,321 B2 * 4/2014 Akiyama ..... G04G 5/002 368/21
9,417,612 B2 * 8/2016 May ..... G04G 9/0076
2011/0051561 A1 * 3/2011 Fujisawa ..... G04G 5/002 368/47
2011/0151415 A1 * 6/2011 Darling ..... G04G 9/0076 434/149
2015/0146503 A1 * 5/2015 Nakanishi ..... G04G 9/0076 368/21

FOREIGN PATENT DOCUMENTS

JP 2009008504 A 1/2009

* cited by examiner

*Primary Examiner* — Sean Kayes
(74) *Attorney, Agent, or Firm* — Holtz, Holtz & Volek PC

(57) ABSTRACT

An electronic timepiece includes: a timer unit configured to count date and time; a current position acquiring unit configured to acquire a current position; an associated position selecting unit configured to select an associated position preset according to a current position when the current position is acquired; a local time calculating unit configured to calculate local time at the current position and local time at the associated position based on the date and time counted by the timer unit, time difference information of the current position and time difference information of the associated position on differences in time from a predetermined reference position; and a display part configured to display the calculated local times simultaneously or by selectively switching therebetween.

11 Claims, 7 Drawing Sheets

| SETTING NUMBER | LOCAL POSITION | SETTING NUMBER | ASSOCIATED POSITION |
|---|---|---|---|
| HT | TOKYO | ST[0] | SYDNEY |
| LT[1] | LOS ANGELES | ST[1] | CHICAGO |
| LT[2] | CHICAGO | ST[2] | NEW YORK |
| LT[3] | NEW YORK | ST[3] | TOKYO |
| LT[4] | LONDON | ST[4] | TOKYO |
| DT | --- | DT | SYDNEY |

FIG. 3A

| SETTING NUMBER | LOCAL POSITION |
|---|---|
| HT | TOKYO |
| LT[1] | LOS ANGELES |
| LT[2] | CHICAGO |
| LT[3] | NEW YORK |
| LT[4] | LONDON |

FIG. 3B

| SETTING NUMBER | LOCAL POSITION | SETTING NUMBER | ASSOCIATED POSITION |
|---|---|---|---|
| HT | TOKYO | ST[0] | SYDNEY |
| LT[1] | LOS ANGELES | ST[1] | CHICAGO |
| LT[2] | CHICAGO | ST[2] | NEW YORK |
| LT[3] | NEW YORK | ST[3] | TOKYO |
| LT[4] | LONDON | ST[4] | TOKYO |
| DT | --- | DT | SYDNEY |

ELECTRONIC TIMEPIECE

BACKGROUND OF THE INVENTION

This invention relates to an electronic timepiece capable of displaying dates and times around the world.

In related art, there are electronic timepieces capable of displaying local time at a current position based on information on an acquired current position or a set position. This allows easy display of exact date and time even when a user does not know the time zone or the daylight-saving time of a place while traveling or the like correctly.

There also are electronic timepieces having a world clock function capable of displaying times around the world in addition to main display of date and time (main clock). Some of such electronic timepieces are provided with a small hour hand and a small minute hand for displaying date and time at another position in addition to a normal hour hand and a normal minute hand or are provided with a digital display screen capable of displaying a sufficient number of digits, so that the date and time at another position can be displayed on a sub clock or a small clock at the same time as the display of a main clock, or some of such electronic timepieces are capable of selectively displaying any of a main clock and sub clocks by switching therebetween with an operation button. Such a world clock function allows the user of an electronic timepiece to quickly know dates and times at multiple places depending on various purposes such as a combination of the time at a current position and the time at another position that is important in business or a combination of the time at a place where a user stays during a trip and the time at a home position where the user has a regular life.

In the related art, however, the date and time of a sub clock are counted and displayed independently of those of a main clock, and the numbers of steps of hands of a sub clock are different from those of a main clock whether the time is displayed in 24-hour display or 12-hour display, which is disadvantageous in that the date and time of the main clock and those of the sub clock need to be modified independently of each other. In contrast, JP 2009-8504 A that is a Japanese patent document, for example, discloses a technology for modifying the date and time (display in minute) of a main clock and modifying the date and time (display in minute) of a sub clock in conjunction with each other.

However, for changing the local time displayed by the sub clock according to a change in the position for the main clock or for replacing the display on the main clock and the display on the sub clock with each other instead of simply modifying the time, the related art is disadvantageous in that the date and time data of the sub clock are not stored in association with position information, which requires manual modification of the sub clock each time in practice or may further result in position information originally set for the main clock being overwritten by different position information.

This invention is directed to an electronic timepiece capable of easily and appropriately changing the local time on a sub clock to that of a desired position in conjunction with changing the local time on a main clock as a result of a change in the current position.

SUMMARY OF THE INVENTION

To achieve the aforementioned object, an aspect of the present invention is an electronic timepiece including: a timer unit configured to count date and time; a current position acquiring unit configured to acquire a current position; an associated position selecting unit configured to select an associated position preset according to a current position when the current position is acquired by the current position acquiring unit; a local time calculating unit configured to calculate local time at the current position and local time at the associated position based on date and time counted by the timer unit, time difference information of the current position and time difference information of the associated position on differences in time from a predetermined reference position; and a display part configured to display the calculated local times simultaneously or by selectively switching therebetween.

BRIEF DESCRIPTION OF THE DRAWINGS

FIGS. 3A and 3B are tables showing examples of contents of position setting information.

DETAILED DESCRIPTION

Embodiments of the present invention will be described below with reference to the drawings.

First Embodiment

Figure 1:
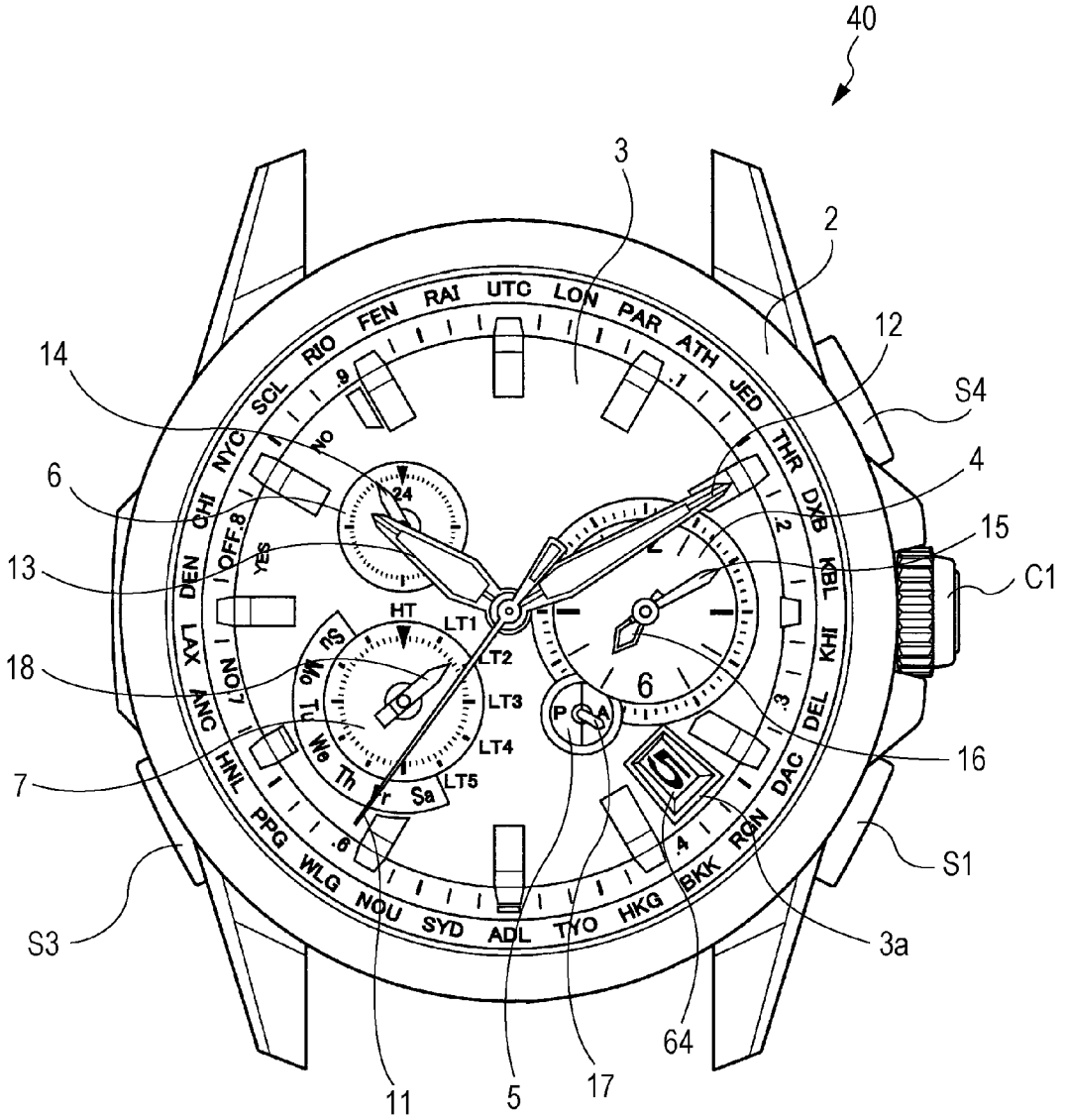
FIG. 1 is a front view of an electronic timepiece according to an embodiment of the present invention.
Figure 2:
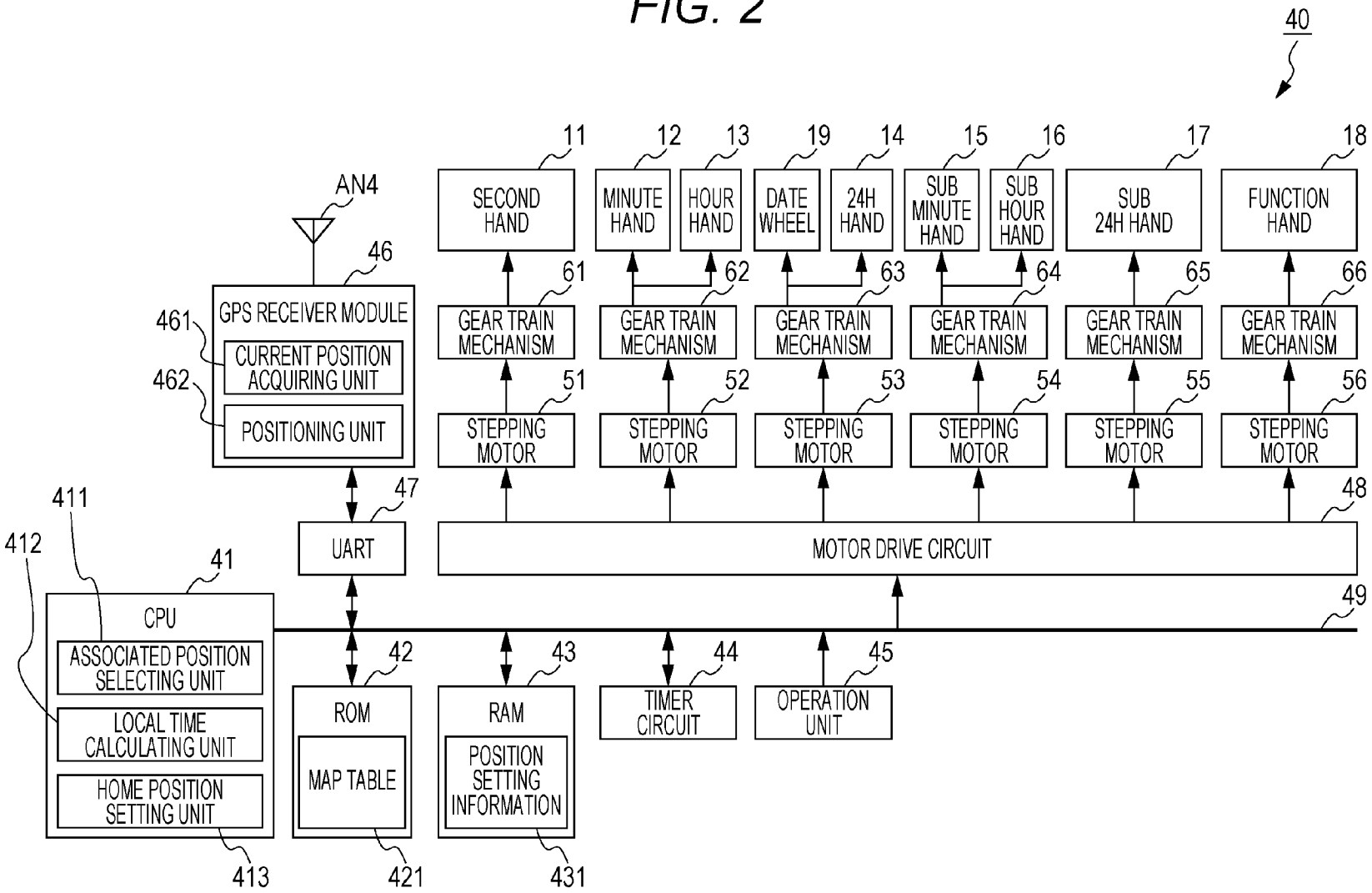
FIG. 2 is a block diagram illustrating a functional configuration of the electronic timepiece.

FIG. 1 is a front view of an electronic timepiece 40 according to a first embodiment of the present invention. FIG. 2 is a block diagram illustrating a functional configuration of the electronic timepiece 40.

As illustrated in FIG. 1, the electronic timepiece 40 includes a frame 2, a dial 3 provided inside of the frame 2, a second hand 11, a minute hand 12, an hour hand 13, a 24-hour hand 14, a sub minute hand 15, a sub hour hand 16, a sub 24-hour hand 17, and a function hand 18 that are arranged on a display surface (top surface) side of the dial 3, a date wheel 19 positioned beneath the dial 3, and push-button switches S1, S3, and S4 and a winder C1 provided on a side face of the frame 2. Hereinafter, some or all of the second hand 11, the minute hand 12, the hour hand 13, the 24-hour hand 14, the sub minute hand 15, the sub hour hand 16, the sub 24-hour hand 17, the function hand 18, and the date wheel 19 will also be collectively referred to as hands 11 to 19. The dial 3 and the hands 11 to 19 constitute a display part.

Top surfaces of the dial 3 and the hands 11 to 18 are covered with a windshield, which is not illustrated. Components for drive control of the electronic timepiece 40 and a power supply unit are provided inside the frame 2 on a bottom surface (a surface opposite to the surface facing the dial 3) of the date wheel 19, and covered with a back cover, which is not illustrated.

The dial 3 is provided with a scale and signs for display relating to time and various other functions. In addition, an opening 3*a* is provided the direction of four thirty, so that a date sign on the date wheel 19 can be selectively exposed.

The second hand 11, the minute hand 12, and the hour hand 13 are rotatable about substantially the center of the dial 3 as a rotation axis, each of the hands being on a plane parallel to the dial 3. The dial 3 has small windows 4, 5, 6, and 7. The 24-hour hand 14 indicates the time indicated by the second hand 11, the minute hand 12 and the hour hand 13 in 24-hour display. The 24-hour hand 14 is rotatable inside the small window 4. The date wheel 19 is a rotatable disc-shaped (including an annular shape having a hole at the center) member provided in parallel with the dial 3 on a bottom surface side of the dial 3, and is provided with date signs of "1" to "31" indicating dates arranged in order at predetermined intervals on the circumference of a circle. The date wheel 19 is rotated and one of the date signs is selectively exposed at the opening 3*a*, so that information on the date associated with the time indicated by the hands 11 to 14 is shown.

The hands 11 to 14, the date wheel 19, the dial 3, and the small window 4 constitute a first display part.

The second hand 11 rotates a predetermined angle at a time with step operation of a stepping motor 51 transferred via a gear train mechanism 61 that is a train of gears. The second hand 11 is used for display of time and for setting a home position and a local position in a world clock by using signs of city names provided on the frame 2.

The minute hand 12 and the hour hand 13 each rotate a predetermined angle at a time with step operation of a stepping motor 52 transferred via a gear train mechanism 62. The angle of rotation of the hour hand 13 per one step is 1/12 of the angle of rotation of the minute hand 12.

The 24-hour hand 14 rotates a predetermined angle at a time with step operation of a stepping motor 53 transferred via a gear train mechanism 63. The date wheel 19 rotates in conjunction with the 24-hour hand 14 while the 24-hour hand 14 is within a predetermined rotational position, such as between 10 p.m. to 2 a.m., so that the date sign exposed at the opening 3*a* changes by one day.

The sub minute hand 15 and the sub hour hand 16 are rotatable inside the small window 5. The sub 24-hour hand 17 is also rotatable inside the small window 6. The sub minute hand 15, the sub hour hand 16, and the sub 24-hour hand 17 serve to display the time different from that indicated by the hands 11 to 14 described above at the same time.

The sub minute hand 15, the sub hour hand 16, the sub 24-hour hand 17, the small window 5, and the small window 6 constitute a second display part.

The sub minute hand 15 and the sub hour hand 16 each rotate a predetermined angle at a time with step operation of a stepping motor 54 transferred via a gear train mechanism 64. The angle of rotation of the sub hour hand 16 per one step is 1/12 of the angle of rotation of the sub minute hand 15. In addition, the sub 24-hour hand 17 rotates a predetermined angle at a time with step operation of a stepping motor 55 transferred via a gear train mechanism 65.

The function hand 18 is rotatable inside the small window 7. The function hand 18 is a hand for display of various functions such as a day of week and other functions. When the position (local position) of local time indicated by the sub minute hand 15 and the sub hour hand 16 is changed, the function hand 18 points a sign "LT(i)" (in FIG. 1, the variable i is 1 to 5) representing a setting number of the position or a sign "HT" representing the home position. The function hand 18 rotates a predetermined angle at a time with step operation of a stepping motor 56 via a gear train mechanism 66.

The function hand 18 and the small window 7 constitute a third display part.

The push-button switches S1, S3, and S4 and the winder C1 are included in an operation unit 45 (operation part) and configured to receive input operation from outside. The push-button switches S1, S3, and S4 receive a pushing operation from outside. The winder C1 receives a rotating operation in a state in which the winder C1 is pulled out from its initial state. The operation unit 45 detects the pushing operation of the push-button switches S1, S3, and S4 and the pulling-out operation, the pushing-back operation, and the rotating operation of the winder C1, and outputs an input signal according to each operation type to a CPU 41.

In addition to the components described above, the electronic timepiece 40 includes, as components for drive control, the central processing unit (CPU) 41 (an associated position selecting unit 411, a local time calculating unit 412, and a home position setting unit 413), a read only memory (ROM) 42, a random access memory (RAM) 43, a timer circuit 44 (a timer unit), a GPS receiver module 46 (a current position acquiring unit 461 and a positioning unit 462), a universal asynchronous receiver/transmitter (UART) 47, an antenna AN4, a motor drive circuit 48, and the like as illustrated in FIG. 2. Among these components, commands and data are sent and received via a bus 49.

The CPU 41 performs various computation processes and generally controls overall operation of the electronic timepiece 40. The CPU 41 also sets a current position and a position for display of world clock, calculates local time at the position, and displays the calculated local time. The CPU 41 includes an associated position selecting unit 411, a local time calculating unit 412, and a home position setting unit 413. The associated position selecting unit 411, the local time calculating unit 412, and the home position setting unit 413 may be constituted by a single CPU or may be individually constituted by separate CPUs to perform operations.

The ROM 42 stores control programs and setting data for operation of the electronic timepiece 40. The ROM 42 has stored therein a map table 421 (a time difference storage unit) for acquiring daylight saving time information relating to time zone setting and daylight saving time schedule at a position based on position information, that is, for acquiring the difference in time (time difference information) from the coordinated universal time (UTC) region that is a reference position. The ROM 42 may include a nonvolatile memory such as a rewritable flash memory. In this case, data in the ROM 42 may be rewritten according to a change in the daylight saving time information or the like as necessary.

The RAM 43 is a volatile memory that provides a working memory space for the CPU 41 and stores temporary data and updatable setting data. The updatable setting data include position setting information 431 (position information storage unit) such as position information on a home position representing the main location of the user and position information on a local position for world clock display by the sub minute hand 15, the sub hour hand 16, and the sub 24-hour hand 17.

The timer circuit 44 counts and holds the current date and time based on a clock signal having a predetermined frequency generated by an oscillator circuit, which is not illustrated. The date and time held by the timer circuit 44 may be a system clock specific to the electronic timepiece 40 or may be reference date and time such as the UTC date and time held in a year-month-day-hour-minute-second format.

The GPS receiver module 46 receives radio waves from positioning satellites constituting the global navigation satellite system (GNSS), and calculates and acquires date and time information and position information on the current position. The acquired date and time information and position information are output to the CPU 41 in a preset format. The type and the output format of data acquired by the GPS receiver module 46 are set by setting input from the CPU 41.

The UART 47 performs serial-to-parallel conversion of various signals transmitted between the GPS receiver module 46 and the CPU 41 into formats appropriate for data transmission and processing.

The motor drive circuit 48 outputs driving voltage pulses at appropriate timings and with an appropriate pulse width to drive the stepping motors 51 to 56 to carry out step operation according to control signals input from the CPU 41. The width of the driving voltage pulses can be adjusted according to a control signal from the CPU 41. When control signals for driving multiple stepping motors at the same time are input, the motor drive circuit 48 outputs driving voltage pulses at shifted driving timings as appropriate within a range in which no problems occur based on the maximum load of the electronic timepiece 40.

Next, operation of switching display time in the electronic timepiece 40 of the present embodiment will be described.

In the electronic timepiece 40 of the present embodiment, time (main clock) displayed by the second hand 11, the minute hand 12, the hour hand 13, and the 24-hour hand 14 and time (sub clock) displayed by the sub minute hand 15, the sub hour hand 16, and the sub 24-hour hand 17 are set in conjunction with each other based on the current position.

FIGS. 3A and 3B are tables showing examples of the position setting information 431 stored in the RAM 43.

As shown in FIG. 3A, in the electronic timepiece 40 of the present embodiment, a home position (HT) and one or more ordered local positions (LT) are set as position information and stored in the position setting information 431 (position information storage unit). The number of local positions that can be stored is determined in advance depending on the memory capacity of the RAM 43, the number of signs that can be arranged in the small window 7, and the like.

In the electronic timepiece 40 of the present embodiment, cities (local cities) in regions visited for a trip are set in order as local positions by user operation or the like. Herein, while Tokyo is the home position (setting number "HT"), Los Angeles with a setting number "LT1," Chicago with a setting number "LT2," New York with a setting number "LT3," and London with a setting number "LT4" are set in this order as the local positions. The local positions are preferably expressed by latitude and longitude, and the latitude and the longitude can be obtained from a city name directly within the position setting information 431 or by means of a separate conversion table. Herein, it is assumed that the home position is ordered before the local position "LT1" (predetermined order), and that all the local positions are ordered in the order of the numbers at the ends of the respective setting numbers. Furthermore, the ordering is in a form of a loop in which the home position comes after London represented by the last setting number "LT4" of the local positions.

Figure 4:
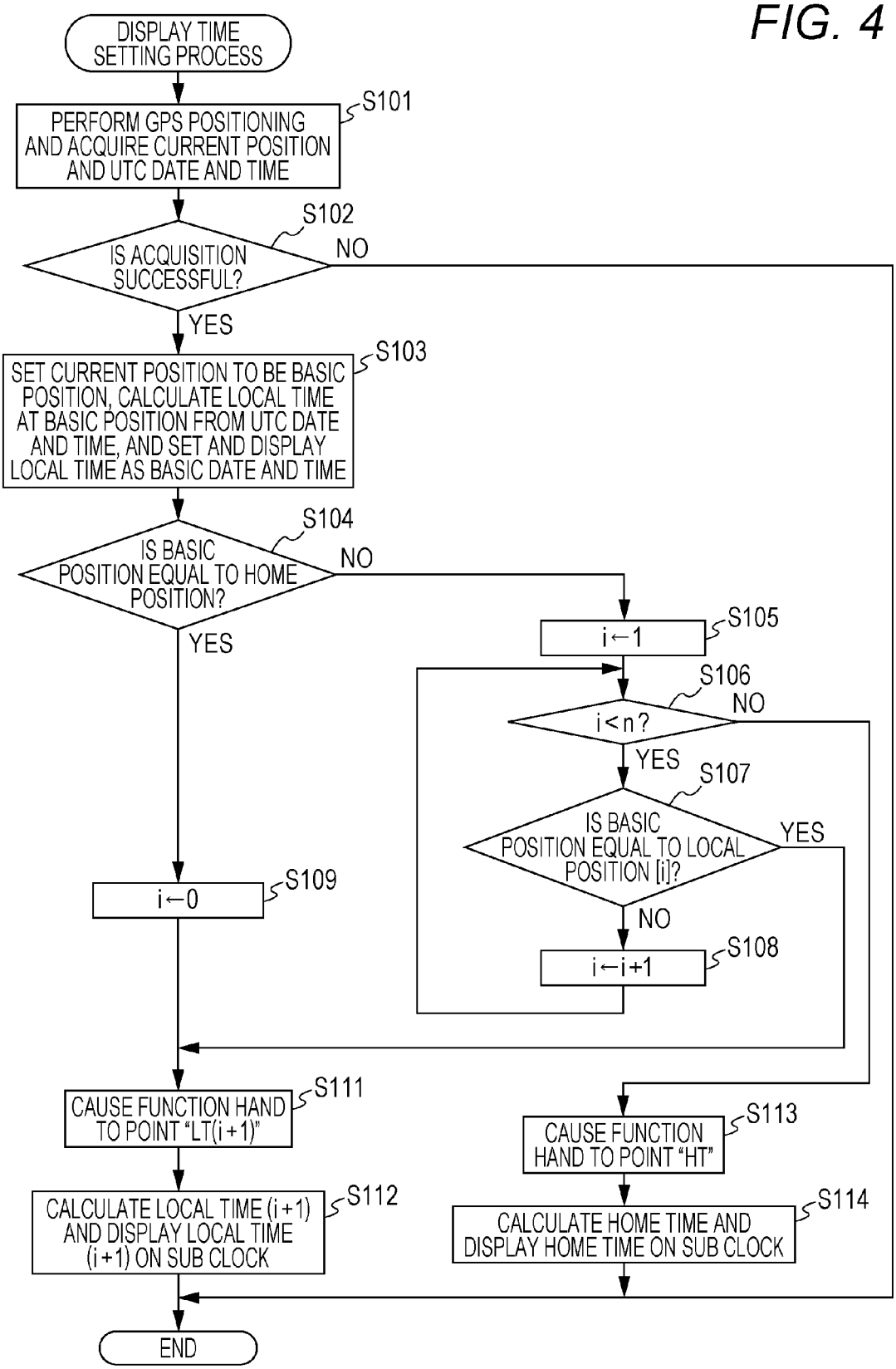
FIG. 4 is a flowchart illustrating control procedure for a display time setting process performed in an electronic timepiece according to a first embodiment.

FIG. 4 is a flowchart illustrating control procedure for a display time setting process performed by the CPU 41 based on the position setting information 431.

The display time setting process is started when a predetermined push-button switch, which is the push-button switch S1 herein, is pressed.

When the display time setting process is started, the CPU 41 starts the GPS receiver module 46 to perform positioning. The CPU 41 acquires data of the current position obtained through the positioning process and the UTC date and time from the GPS receiver module 46 (step S101).

The CPU 41 determines whether or not the acquisition of the data of the current position and the date and time from the GPS receiver module 46 is successful (step S102). If it is determined that the acquisition is not successful (results in a failure) ("NO" in step S102), the CPU 41 terminates the display time setting process.

If it is determined that the acquisition of the data of the current position and the date and time is successful ("YES" in step S102), the CPU 41 sets the acquired current position to be a basic position, refers to the map table 421 to obtain the time reference and the status of daylight saving time at the basic position, and calculates the local time at the basic position. The CPU 41 outputs a control signal for displaying the calculated local time as basic date and time on the main clock to the motor drive circuit 48 (step S103).

The CPU 41 determines whether or not the set basic position is equal to the home position (step S104). The range in which the positions are equal will be described later. If the basic position is determined to be equal to the home position ("YES" in step S104), the CPU 41 sets the variable i to "0" (step S109), and advances the process to step S111.

If the basic position is determined not to be equal to the home position ("NO" in step S104), the CPU 41 sets the variable i to "1" (step S105). The CPU 41 determines whether or not the value of the variable i is smaller than the number n of the set current local positions (step S106). If the value of the variable i is determined to be smaller ("YES" in step S106), the CPU 41 determines whether or not the set basic position is equal to the local position of the variable i (that is, the i-th local position) (step S107). If the basic position is determined not to be equal to the i-th local position ("NO" in step S107), the CPU 41 adds "1" to the variable i (step S108), and returns the process to step S106. If the basic position is determined to be equal to the i-th local position ("YES" in step S107), the CPU 41 advances the process to step S111.

After advancing to the processing of step S111 from the processing of step S107 or step S109, the CPU 41 outputs a control signal to the motor drive circuit 48 to cause the function hand 18 to point a sign "LT(i+1)" for setting position (step S111). The CPU 41 acquires the time difference and daylight saving time information of the local position with the setting number LT(i+1) from the map table 421, calculates the local time (local time [i+1]) of this local position, and outputs a control signal to the motor drive circuit 48 to display the local time by the sub clock (step S112). The CPU 41 then terminates the display time setting process.

If the value of the variable "i" is determined not to be smaller than (or to be equal to) the number n of the set local positions in the determination of step S106 ("NO" in step S106), the CPU 41 outputs a control signal to the motor drive circuit 48 to cause the function hand 18 to point the sign "HT" for setting position (step S113). The CPU 41 calculates the local time (home time) at the home position, and outputs a control signal to the motor drive circuit 48 to display the local time at the home position on the sub clock (step S114). The CPU 41 then terminates the display time setting process.

Specifically, in the electronic timepiece 40 of the present embodiment, while a user leaves the home position, moves to a plurality of local positions in the set order, and returns to the home position, the local time at a position (current position) where the user currently stays is displayed on the main clock, and the time at a position (associated position) where the user will stay next in association with the current position is displayed on the sub clock. Furthermore, if the user has moved to a local position that is not in the set order (none of the ordered local positions), the home position set at a predetermined number in the order, which is at the top of the order herein, is the local position to be displayed on the sub clock.

Figure 5:
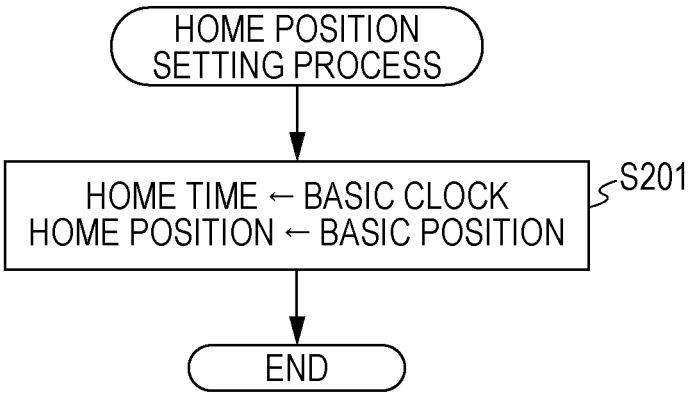
FIG. 5 is a flowchart illustrating control procedure for a home position setting process.

FIG. 5 is a flowchart illustrating control procedure for a home position setting process performed by the CPU 41.

The home position setting process is started when a user operation for setting a home city is performed, such as when the push-button switch S4 is pressed continuously for a predetermined time.

When the home position setting process is started, the CPU 41 sets the position currently set as the basic position to be the home position. The CPU 41 also sets the current basic time as the home time (step S201). The CPU 41 then terminates the home position setting process.

In this manner, the basic position, that is, the current position can be set to be the home position by one operation. Thus, a current position of a short stay or the like can be set as a basic position while a current position of a long stay due to job relocation, transfer or the like can further be changed to the home position.

As described above, the electronic timepiece 40 of the first embodiment includes the timer circuit 44 for counting the date and time, the GPS receiver module 46 for acquiring a current position, the display part for displaying the main clock and the sub clock with the hands 11 to 19 on the dial 3, and the CPU 41. When a current position is acquired by the GPS receiver module 46, the CPU 41 (the associated position selecting unit 411) selects a preset local position according to the current position. The CPU 41 (the local time calculating unit 412) calculates the local time at the current position and the local time at the local position, based on the data and time counted by the timer circuit 44, time difference information on the time difference at the current position from the UTC time and time difference information at the selected local position, and displays the calculated local times at the same time or by selectively switching display therebetween on the display part.

Thus, when the local time on the main clock is changed owing to a change in current position, the local time on the sub clock can be easily and appropriately changed in conjunction with the change of the main clock.

Furthermore, the map table 421 storing time difference information around the world is included and the CPU 41 refers to the map table 421 to acquire time difference information of a current position and of a local position. As a result, the local times can be easily and reliably calculated and displayed at any place in the world.

Furthermore, the position setting information 431 storing position information in which preset home position and local positions are ordered is included and, when the current position is any one of positions ordered in position information stored in the position setting information 431 the CPU 41 selects the position immediately after the current position in the order to be the local position to be displayed on the sub clock. As a result, it is only necessary to set desired home position and local positions in order, so that the setting of world clock can be automatically changed according to the current position when the current position is changed.

Furthermore, when an acquired current position is none of the ordered positions in the position information stored in the position setting information 431, the CPU 41 selects a position set with a predetermined number in the order in the position setting information 431, such as the home position set to the "0"-th position, to be the local position to be displayed on the sub clock. As a result, in such a case where the user at a place during a trip or the like merely wants to know the local time at the home position or the position where his/her family live, the local position to be displayed on the sub clock can further be easily changed and displayed without resetting the order.

Furthermore, the home position that is a main location of the user is included in the ordered positions and, when a current position is none of the ordered positions in the position information stored in the position setting information 431, the CPU 41 selects the home position as the position of local time to be displayed on the sub clock. As a result, display of the sub clock at the last place (after the predetermined order) where the user stays before returning to the home position can be easily selected. Furthermore, in a case of a business trip or a trip to a single destination, the user can easily know the current time of the home position to which the user returns without taking the trouble of setting the trip destination. In addition, when there is a plurality of trip destinations, the user needs to know only the current time and the time at the home position in some cases. In such a case as well, it is not necessary to set and register the places where the user will be staying as local positions in order, and the exact current time can be flexibly and easily acquired in response to a change in the current position and displayed with the time of the home position.

Furthermore, the operation unit 45 for receiving user's input operation is included, and position information to be stored in the position setting information 431 can be input and set through the input operation to the operation unit 45. As a result, in particular, in a case of simple setting, the local position for the sub clock according to the current position for the main clock can be easily set at hand.

Furthermore, when a predetermined input operation, such as a long press of the push-button switch S4 herein, is performed, a current position can be set to be the home position that is the main location of the user. As a result, when the home position itself needs to be switched instead of a simple change in the basic position because of a move or a long stay, the home position can also be easily set by a single-touch operation after acquisition of the current position.

Furthermore, the main clock display of displaying the local time at a current position by the hands 11 to 14 on the dial 3 and the sub clock display of displaying the local time at a local position within the small windows 5 and 6 can be achieved at the same time. As a result, the user can visually recognize the main clock and the sub clock and know the times at the current position and the local position and the time difference therebetween quickly without any operation to switch the display.

Furthermore, the current position can be pointed by the function hand 18 in the small window 7. As a result, when the current position for the main clock display has been switched, the user can quickly check whether the time display has been switched to that of the correct current position.

Furthermore, since the GPS receiver module 46 is used to position the current position, the current position can be accurately acquired at any place around the world with the electronic timepiece 40 alone. As a result, the current position can be acquired automatically or by a simple operation and the main clock display and the sub clock display can be quickly switched according to the current position while the user is moving.

Furthermore, the time difference information includes information on the time zone and daylight saving time information on the daylight saving time schedule. As a result, for any of the main clock and the sub clock, an exact local time can be calculated and displayed in view of not only the time difference between different time zones but also the daylight saving time schedule around the world.

Second Embodiment

Next, an electronic timepiece 40 according to a second embodiment will be described.

Since the components of the electronic timepiece 40 of the second embodiment are the same as those of the electronic timepiece 40 of the first embodiment illustrated in FIGS. 1 and 2, the same reference numerals will be used therefor and the description thereof will not be repeated.

Figure 6:
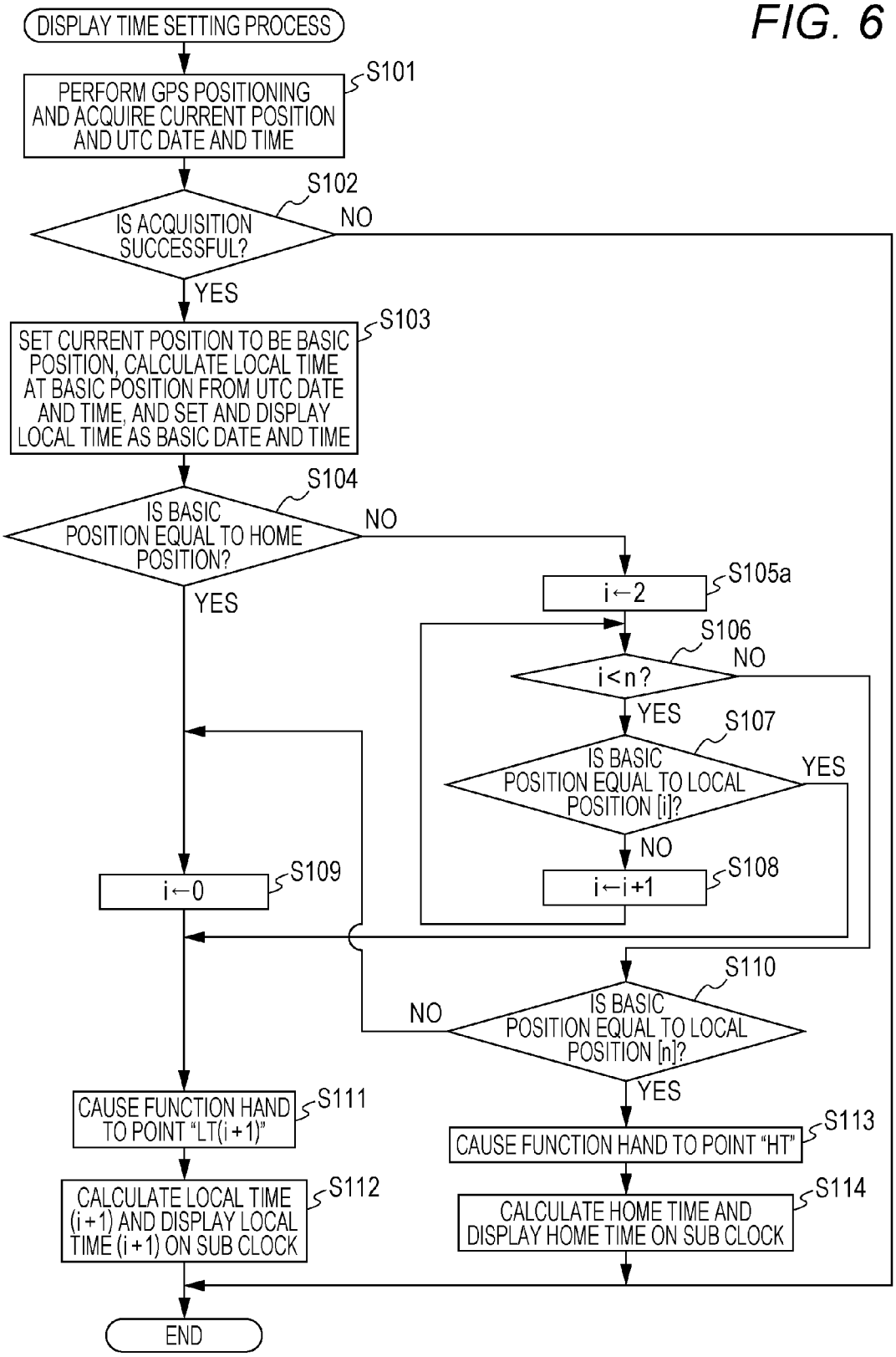
FIG. 6 is a flowchart illustrating control procedure for a display time setting process performed by an electronic timepiece according to a second embodiment.

FIG. 6 is a flowchart illustrating control procedure for a display time setting process performed by the CPU 41 in the electronic timepiece 40 according to the second embodiment.

The display time setting process in the electronic timepiece 40 of the second embodiment is different from that i the electronic timepiece 40 of the first embodiment in that the processing of step S105 is replaced by processing of step S105*a* and in that processing of step S110 is added. The other steps are the same and will be designated by the same reference numerals, and detailed description thereof will not be repeated.

If the basic position is determined not to be equal to the home position in the processing of step S104 ("NO" in step S104), the CPU 41 sets the variable i to "2" (step S105*a*).

Furthermore, if the value of the variable i is not smaller than (or to be equal to) the number n of set local positions in the determination process of step S106 ("NO" in step S106), the CPU 41 further determines whether or not the basic position is equal to the n-th local position (step S110). If the basic position is determined to be equal to the n-th local position (LT[n]) ("YES" in step S110), the process of the CPU 41 proceeds to step S113. If the basic position is determined not to be equal to the local position [n] ("NO" in step S110), the process of the CPU 41 proceeds to step S109.

Thus, in the display time setting process of the present embodiment, in a case where the user of the electronic timepiece 40 is at the home position or in a case where the user is not at any of the set local positions, the local time at the first local position (local position [1]) (specific position) excluded from the order described above is displayed on the sub clock, and only when the user is at a trip destination set as a second or subsequent local position, the local time at a position where the user is staying next is displayed on the sub clock.

As described above, in the electronic timepiece 40 of the second embodiment, the local position LT[1] is excluded from the order described above in the position information stored in the position setting information 431, and when the acquired current position is none of the home position HT and the local positions LT[2] to LT[n] that are ordered, the CPU 41 selects the local position LT[1] as the position for display on the sub clock.

As a result, when the user wants to usually fix the local time at the set local position on the world clock display, except for a case in which the user is moving to a set destination, the local position is excluded from the order in this manner while being contained in the position setting information 431, which enables more flexible world clock display that is suitable for the user's purpose.

Third Embodiment

Next, an electronic timepiece 40 according to a third embodiment will be described.

Since the components of the electronic timepiece 40 of the third embodiment are the same as those of the electronic timepiece 40 of the first embodiment illustrated in FIGS. 1 and 2 except for the content of the position setting information 431, the same reference numerals will be used for the same components and the description thereof will not be repeated.

FIG. 3B is a table showing the content of the position setting information 431 in the electronic timepiece 40 of the present embodiment.

In the electronic timepiece 40 of the present embodiment, associated positions ST[0] to ST[4] associated with the respective set positions (the home position and the local positions) are set as the position setting information 431, and a default position DT is set as an associated position (predetermined position) associated with an unset position.

The position setting information 431 in the electronic timepiece 40 of the present embodiment constitutes an associated position setting storage unit.

Figure 7:
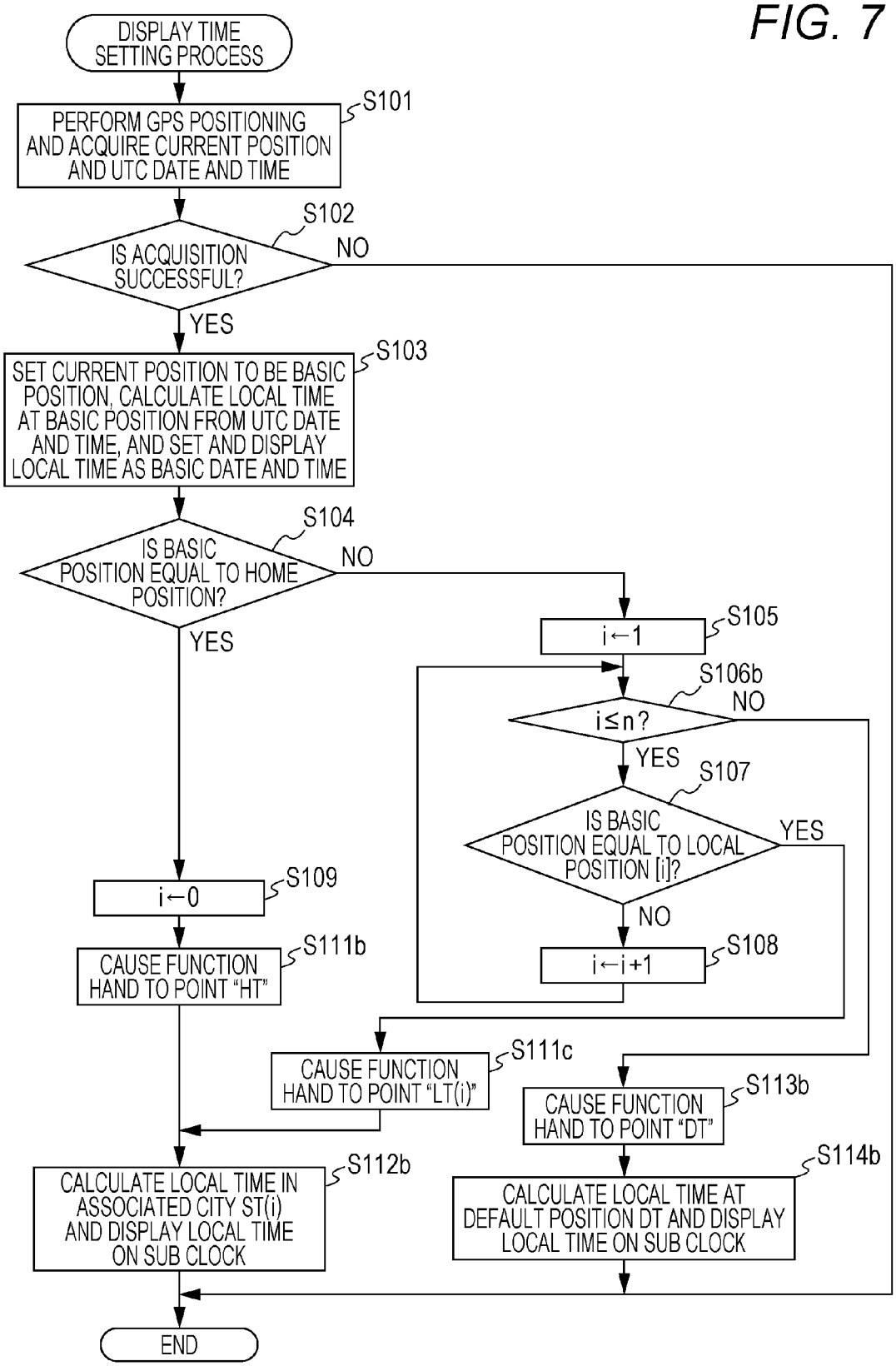
FIG. 7 is a flowchart illustrating control procedure for a display time setting process performed by an electronic timepiece according to a third embodiment.

FIG. 7 is a flowchart illustrating control procedure for a display time setting process performed by the CPU 41 in the electronic timepiece 40 according to the third embodiment.

The display time setting process of the electronic timepiece 40 of the third embodiment is the same as that in the electronic timepiece 40 of the first embodiment except that the processing of step S106 and steps S112 to S114 is replaced by that of step S106*b* and steps S112*b* to S114*b*, respectively, and except that the processing of step S111 is divided and changed into steps S111*b* and S111*c*. The same processing steps will be designated by the same reference numerals and detailed description thereof will not be repeated.

In processing of step S106*b*, the CPU 41 determines whether or not the value of the variable "i" is equal to or smaller than the number n of set local positions (step S106*b*). If the variable "i" is determined to be equal to or smaller than the number n ("YES" in step S106*b*), the process of the CPU 41 proceeds to step S107.

When the processing of step S109 is completed, the CPU 41 sends a control signal to the motor drive circuit 48 to cause the function hand 18 to point a sign "HT" indicating the home position for setting position (step S111*b*), and the process of the CPU 41 then proceeds to step S112*b*.

If "YES" is selected in step S107, the CPU 41 outputs a control signal to the motor drive circuit 48 to cause the function hand 18 to point a sign "LT(i)" indicating the "i"-th local position for setting position (step S111*c*). The process of the CPU 41 then proceeds to step S112*b*.

In processing of step S112*b*, the CPU 41 displays the local time at the "i"-th local position (LT[i]) on the sub clock (step S112*b*). The CPU 41 then terminates the display time setting process.

If the variable "i" is determined not to be equal to or smaller than the number n ("NO" in step S106*b*), the CPU 41 outputs a control signal to motor drive circuit 48 to cause the function hand 18 to point a sign "DT" indicating the default position for setting position (step S113*b*). The CPU 41 calculates the local time (default time) of the default position, and rotates the sub minute hand 15 and sub hour hand 16 to display the local time of the default position on the sub clock (step S114*b*). The CPU 41 then terminates the display time setting process.

As described above, the user can display the local times at positions each determined according to the current position for which the current time is displayed. For example, in a case where the user is at the home position (Tokyo), a position (Sydney) where a member of his/her family studies or the like can be set as an associated position. In a case where the user is at a business trip destination away from the home position, the next place the user will be staying and the home position can be set as associated positions.

Note that the default position is a position for which the local time is displayed as the sub clock when the user has moved to a region different from the destinations set in advance. For example, the default position can be used for the following purposes: during a business trip to a predetermined destination, the home position is always set as an associated position so that communication with those in a headquarter or the like can be facilitated; or when the time of the home position need not be always displayed during a sightseeing trip or the like, the place where a member of the family studies may be preferentially set as an associated position.

The ordering of positions includes setting the position immediately after the local position with the last number to be the home position or the local position with the first number. Note that the positions need not be ordered in the order of data arrangement in the position setting information 431, and only necessary local positions depending on situation may be selected and ordered separately.

As described above, in the electronic timepiece 40 of the third embodiment, position information on preset home position and local positions, and on associated positions associated with the respective positions is stored in the position setting information 431, and when an acquired current position is any one of the preset positions, an associated position associated with the current position in the position information is selected, so that it is possible to select whether or not to display the local time at the home position, whether or not to display the local time at the next place where the user will be staying, and the like as necessary for each of the home position and the positions where the user stays for trip and the like. As a result, when display is switched to the local time at a current position, display of the world clock can also be switched to that meeting the user's needs better.

Furthermore, when an acquired current position is none of the home position and the local positions preset in the position setting information 431, a default position DT set separately in advance can be set to be an associated position. As a result, when the user has moved to an unscheduled position or when the user prefers the local time at the default position as the world clock display without needing to set an associated position for the world clock display while the user is moving to the position, the world clock display can be more easily and appropriately changed with the switching of display to the local time at the current position.

Furthermore, the operation unit 45 for receiving user's input operation is included, and the user can input and set position information via the input operation to the operation unit 45. As a result, the setting can be easily changed according to the user's needs, and the display of the sub clock can be changed according to a change in the display of the main clock accompanying traveling of the user.

Note that the present invention is not limited to the embodiments described above, but various modifications can be made thereto.

For example, while the current position is acquired through reception of radio waves from positioning satellites in the embodiments described above, current position data may be acquired indirectly by use of short-range communication such as Bluetooth (registered trademark). Alternatively, the current position may be acquired based on user's input operation.

Furthermore, while different associated positions are set for multiple local positions in the embodiments described above, an associated position of the home position may simply be one local position and associated positions of all the local positions may simply be the home position.

Furthermore, while the map table 421 is referred to for acquisition of time difference information in the embodiments described above, the most recent daylight saving time schedule information may be acquired through user's input operation, reception of standard radio waves, or the like.

Furthermore, the home position data need not necessarily be the starting point and the terminal point of a round-trip route.

Furthermore, the setting data stored as the position setting information 431 may not only be set via the operation unit 45 but also be data set outside and received through short-range communication such as Bluetooth.

Furthermore, while an electronic timepiece capable of displaying basic time at a current position and local time at a position associated with the current position at the same time has been explained in the embodiments described above, the times need not necessarily be displayed at the same time, and the electronic timepiece can be used to set the local position and the local time for the world clock to be displayed when a world clock display state is selected.

Furthermore, while the display time setting process is started in response to an operation of pressing the push-button switch S1 in the embodiments described above, the display time setting process may alternatively be started automatically when an airplane mode in which reception of radio waves from positioning satellites is suspended in an airplane is turned off or when acceleration for landing after takeoff of an airplane is detected by an electronic timepiece having an acceleration sensor, for example.

Furthermore, in addition to a current position, a local position for setting the world clock can be displayed similarly. The display modes are switched and hands are operated so that it is clear which of the local time at a current position and the local time at a local position set for the world clock is displayed. This display need not be indicated by the function hand 18, and may be similar to the setting of a normal world clock using the second hand 11. However, in a case of regions which are in the same time zone provided on the frame 2 and in which different daylight saving time schedules are adopted, for example, the display is preferably made in combination with operation of another hand as appropriate.

Furthermore, while the daylight saving time is automatically applied when the local time is calculated in the embodiments described above, only the time zone may be reflected in and the daylight saving time rule may not be applied to calculation and display of the local time when a setting that does not automatically apply the daylight saving time rule can be used.

Furthermore, while an example of an analog electronic timepiece is described in the embodiments described above, a digital electronic timepiece including a digital display screen such as a liquid crystal display and an electronic time piece combining a digital display screen and display using hands may be applied. Furthermore, in a case of an analog electronic timepiece capable of displaying two times at the same time, the times are not limited to be displayed by a combination of a full-screen display and a small window display, and may alternatively be displayed in two windows arranged in parallel.

Other specific details of the components, settings, control, procedures and the like presented in the embodiments described above can be modified as appropriate without departing from the scope of the present invention.

While some embodiments of the present invention has been described above, the scope of the present invention is not limited to the embodiments described above but includes the scope of the invention defined in the claims and the scope of equivalents thereof.

What is claimed is:

1. An electronic timepiece comprising:

a timer unit configured to count date and time;

a current position acquiring unit configured to acquire a current position;

an associated position selecting unit configured to select an associated position preset according to a current position when the current position is acquired by the current position acquiring unit;

a local time calculating unit configured to calculate local time at the current position and local time at the associated position based on the date and time counted by the timer unit, time difference information of the current position and time difference information of the associated position on differences in time from a predetermined reference position;

a display part configured to display the calculated local times simultaneously or by selectively switching therebetween; and a position information storage unit configured to store position information containing preset positions that are ordered, wherein when the current position is one of the ordered positions in the position information storage unit, the associated position selecting unit selects a position immediately after the current position in the order as the associated position.

2. The electronic timepiece according to claim 1, further comprising:

a time difference storage unit configured to store time difference information around world, wherein the local time calculating unit refers to the time difference storage unit to acquire the time difference information of the current position and the time difference information of the associated position.

3. The electronic timepiece according to claim 1, wherein when the current position is none of the ordered positions in the position information stored in the position information storage unit, the associated position selecting unit selects a position with a predetermined number in the order in the position information storage unit as the associated position.

4. The electronic timepiece according to claim 1, wherein:

the position information stored in the position information storage unit contains a specific position that is not ordered, and when the current position is none of the ordered positions in the position information stored in the position information storage unit, the associated position selecting unit selects the specific position as the associated position.

5. The electronic timepiece according to claim 1, wherein:

the ordered positions include a home position that is a main location of a user, and when the current position is none of the ordered positions in the position information stored in the position information storage unit, the associated position selecting unit selects the home position as the associated position.

6. The electronic timepiece according to claim 1, further comprising: an operation unit configured to receive a user's input operation, wherein the position information to be stored in the position information storage unit is input via the operation unit.

7. The electronic timepiece according to claim 6, further comprising a home position setting unit configured to set the current position to be a home position that is a main location of a user when a predetermined input operation is performed.

8. The electronic timepiece according to claim 1, wherein the display part includes:

a first display part configured to display local time at the current position; and a second display part configured to display local time at the associated position.

9. The electronic timepiece according to claim 1, wherein the display part includes a third display part configured to display the current position.

10. The electronic timepiece according to claim 1, wherein:

the current position acquiring unit includes a positioning unit configured to measure a current position, and the associated position selecting unit causes the positioning unit to conduct positioning under a predetermined condition to acquire the current position.

11. The electronic timepiece according to claim 1, wherein the time difference information contains information on a time zone and daylight saving time information on daylight saving time schedule.

* * * * *